US005145472A

United States Patent [19]

Johnson, III et al.

[11] Patent Number: 5,145,472

[45] Date of Patent: Sep. 8, 1992

[54] PHYSICAL FITNESS EXERCISE MACHINE

[76] Inventors: David S. Johnson, III, 2215 Calle Culebra, Summerland, Calif. 93067; Louis A. Brown, 11396 Gold County Blvd., Gold River, Calif. 95670

[21] Appl. No.: 696,561

[22] Filed: May 3, 1991

[51] Int. Cl.[5] ..... A63B 7/00

[52] U.S. Cl. ..... 482/37; 482/119

[58] Field of Search ..... 272/67, 62, 63, 69, 272/70, 114, 112, 132

[56] References Cited

U.S. PATENT DOCUMENTS

| | | | |
|---|---|---|---|
| 4,355,633 | 10/1982 | Heilbron | 272/112 X |
| 4,611,807 | 9/1986 | Castillo | 272/132 |
| 4,822,029 | 4/1989 | Sarno et al. | 272/132 X |
| 4,842,272 | 6/1989 | Jennings | 272/132 |
| 4,848,737 | 7/1989 | Ehrenfield | 272/112 X |

FOREIGN PATENT DOCUMENTS

| | | | |
|---|---|---|---|
| 2006887 | 9/1971 | Fed. Rep. of Germany | 272/112 |
| 23423 | 2/1977 | Japan | 272/112 |
| 1377102 | 2/1988 | U.S.S.R. | 272/67 |

*Primary Examiner*—Robert Bahr
*Attorney, Agent, or Firm*—Donald D. Mon

[57] ABSTRACT

An upper body exerciser having a frame which supports a rotatable head that has an axis of rotation. The head has two end plates with radially extending slots in which cross rods are reciprocably radially movable. A track mounted to the frame below the axis of rotation provides a sloping support for cross-rods below the axis so that a person hanging from such a rod moves the cross rod down and draws the next one toward him in a sequence simulating a "monkey bar" movement.

10 Claims, 2 Drawing Sheets

PHYSICAL FITNESS EXERCISE MACHINE

FIELD OF THE INVENTION

This invention relates to physical fitness exercise machines and more particularly relates to an exercise machine that simulates the excerise of the hand-walking horizontal ladder commonly referred to as "monkey bars".

BACKGROUND OF THE INVENTION

With health and fitness increasingly being emphasized there is an ever-increasing number and variety of machines on the market. Many of these machines simulate various types of exercise with the intention of giving the user the advantage of the exercise in the comfortable confines of his own home. These machines include ski simulating machines, step climbing machines and treadmills to allow jogging in place. The ski simulating machines have track mounted skis that reciprocate and hand operated cables to simulate arm and shoulder movements. The stairstep machine simulates stair climbing allowing the step to descend rather than for the climber to rise. This eliminates the need for stairs and allows "in-place" stair climbing excerise in a low-ceilinged room.

There are machines which simulate in one form or another most if not all of the popular playground fitness program exercises. One such popular exercise is the hand-walking exercise performed on horizontal overhead ladders, commonly called "monkey bars" found on playgrounds and also used in military training exercises. The primary object of this exerciser is to promote total upper body fitness and coordination. The user grasps the first rung of the horizontal ladder and "walks" hand over hand from one end of the other while elevated above a surface or the ground. It is an object of the present invention to provide a compact, stationary exercise machine that simulates the exercise performed on the horizontal ladder or "monkey bars" without requiring the forward movement of the user. Thus the advantage of a device which usually requires a long space to accommodate it can be had in only a few feet.

Still another object of the present invention is to provide an excerise machine that stimulates a horizontal ladder exercise device with a reel having a plurality of equally spaced rungs which are radially displaced by tracks which engage rollers on the end of each rung.

BRIEF DESCRIPTION OF THE INVENTION

The purpose of the present invention is to provide an exercise device that simulates a horizontal ladder exercise device.

This device is constructed of a pair of parallel frames having sprockets at the upper ends. A head (sometimes called a "reel") is rotatably mounted on an axle fitted in bearings in the sprockets. A plurality of radially displacable rungs are equally angularly spaced around the reel and have rollers on each end. The reel has a plurality of equally placed radial slots which allow the rungs to be displaced from a position near the periphery of the reel toward the center as the reel rotates. In effect they reciprocate radially in the slots.

A track or rail mounted on either side of the frame beneath the sprockets engages the rollers on the outer ends of the rungs and displaces them as the reel or head rotates. The tracks or rails are downward-sloping to a point where they become parallel to the surface the frame is mounted on. Three of the rollers at each end of rungs are always in contact with a rail. A guide mounted on the frame forces the rollers and rungs outward as the reel rotates, thereby displacing them to the farthest position from the center as they reach the uppermost position. The rung at the top is at the upper end of the slot near the periphery of the reel while the rung at the bottom is at the point a point near to the center point in the slot nearest the center of the reel.

To exercise with the machine a user grasps the rung or rod at the lowermost point with both hands and suspends his body either partially or fully above the surface or ground. Excerise of the upper body is performed by grasping the next rod in front of the user in succession, with alternating hands repeatedly. With body weight partially or fully suspended, the head or reel rotates. This positions the next cross rod (or its rung rollers) onto the track or rail, allowing the body to swing forward while the rods rolls along the rail. The user continues to grasp the next cross rod in front of him with alternate hand movements while releasing the previously grasped rod. Thus simulates the horizontal movement along the monkey bars but without requiring a long path length.

The above and other features of this invention will be fully understood from the following detailed description and the accompanying drawings, in which:

DETAILED DESCRIPTION OF THE INVENTION

Figure 1:
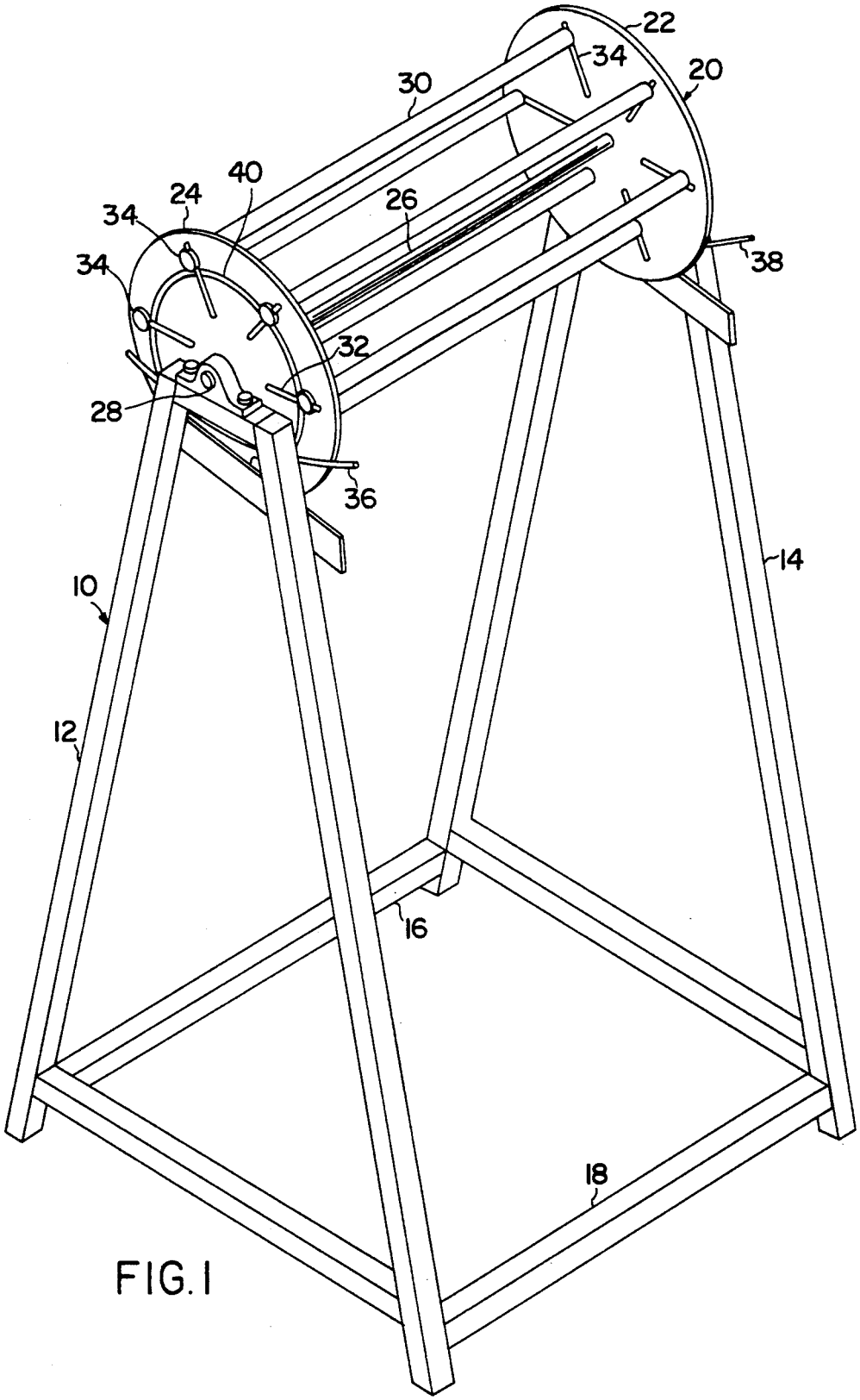
FIG. 1 is a perspective view of a physical fitness exercise machine constructed according to the invention; and FIGS. *2a* through *2f* illustrate the movement of the exercise machine head during the hand to hand walking simulation.
Figure 2A:
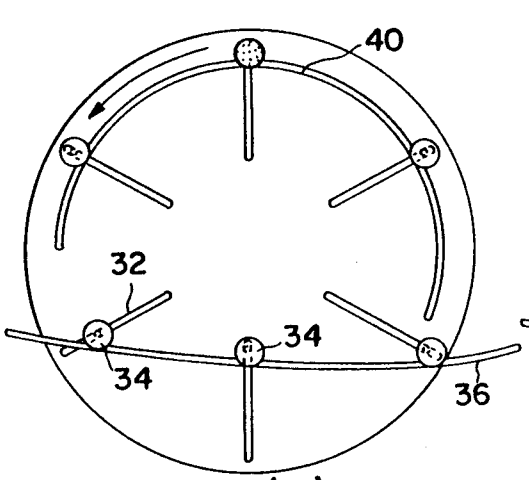
Figure 2B:
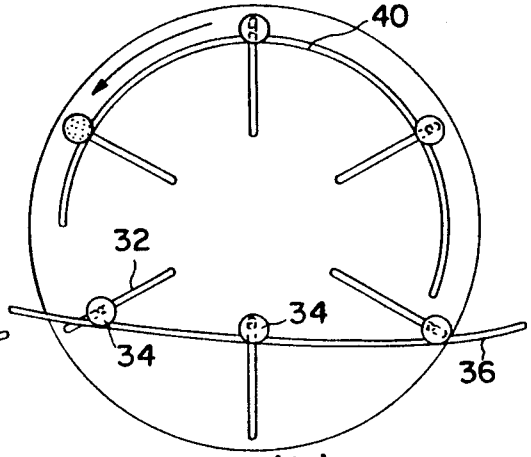
Figure 2C:
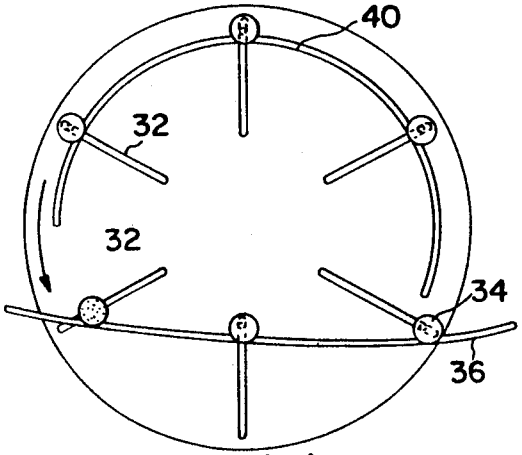
Figure 2D:
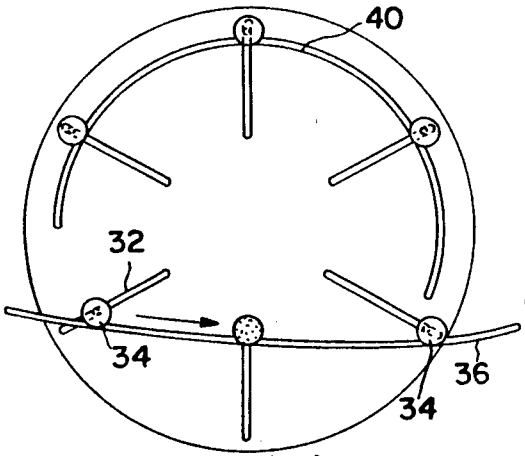
Figure 2E:
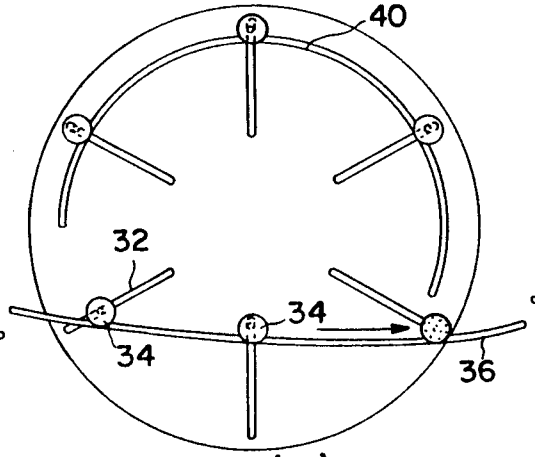
Figure 2F:
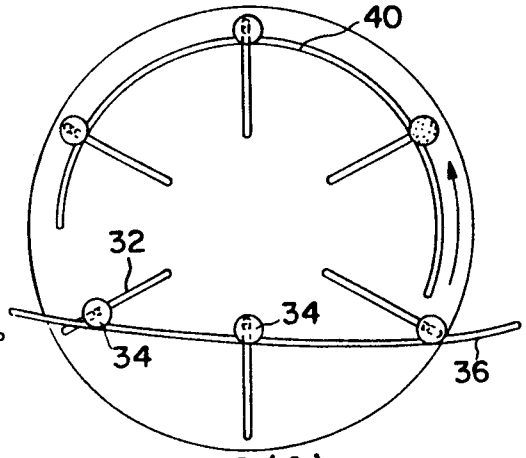

An exercise machine constructed according to the invention is illustrated in FIG. 1. The machine is comprised of a pair of A frames 12 and 14 joined to cross struts 16 and 18 to provide rigid support for the device.

The rotating head 20 is mounted on the upper end of supporting frame 10 and is comprised of circular plates 22 and 24 mounted on axle 26 which rtoates in a bearing block 28 on both sides of frame 10. Cross rods 30 pass through slots 32 in plates 22 and 24 and have rollers 34 mounted on each end.

The cross rods 30 and rollers 34 are free to move radially in slots 32. A track or rail 36 and 38 at either side of frame 10 is constructed to engage support the rollers 34 on cross rods 30 allowing them to be displaced from the periphery toward the end of slots 32 near the center. A guide rail 40 on either side of frame 10 near its top forces the cross bars and rollers 34 away from the center as head 20 rotates for part of their passage.

The operation of the excerise machine to simulate monkey bars is illustrated in FIGS. *2a* through *2f*. Each figure will be described in terms of a clock with the uppermost position being 12:00 and the lowermost position being 6:00 . An operator jumps up, and grips the cross bar mounted on roller 34 of the three which are resting on track 36 at the 4, 6, and 8:00 positions. Since track 36 is slightly angled, the roller 34 at the 8:00 position will be displaced slightly along slot 32. The exercise begins by reaching forward from the cross bar in the 6:00 position to the cross bar in the 8:00 position. This is the same exercise that would be done in negotiating monkey bars or a horizontal ladder. As the cross bar at the 8:00 position on rollers 34 is grasped, the downward slope of track 36 causes the cross bar to move towards the 6:00 position inducing the operator to reach out with the opposite hand and grab the next bar at arms length. Thus as the operator moves from the bar at the 6:00 position to the bar at the 8:00 position, the bar moves to the 6:00 position causing the operator to reach forward to the next rod that is swung down to the 8:00 position. This completes one repetition of the exercise. The rollers continuously move from an 8:00 position to a 6:00 position as the operator reaches forward to grasp the bar, letting go of the lower bar and allowing the person to simulate the hand walking exercise across a horizontal ladder or monkey bars without requiring substantial horizontal movement. The rollers or cross bars are returned to the outer position in the slot by the action of guide rail 40 engaging which engages the rollers as they leave track 36.

Each successive repetition of the exercise by moving from a cross bar in the 6:00 position to a cross bar in the 8:00 position effectively exercises the entire upper body from the fingers, hands, arms shoulders, and latissumus dorsi muscles. The swinging motion created by the body moving from the exercise stretches, tones and exercises the abdominal muscles, the obleques, the serratus maximus, and the spinal erectors, completing a total upper body workout.

While the drawings illustrate a rotating head or reel having six cross bars or rungs, more or less could be provided as desired. There must, however, be at least two resting on rail 36 the neutral or lower cross bar and at least one which is uphill from it that the operator can reach to grasp.

The speed of operation depends in large part on the vigor of the user. Many users will prefer to pause at the end of each reach. Others will try to keep the reel moving steadily. The rate is at least partially limited by the freedom of the reel to rotate, and by the steepness of track 36.

A drag brake (not shown) may be interposed between the reel and its support. It will slow the movement because it dissipates energy that otherwise would rotate the reel.

Also, adjustment means (not shown) can be provided to adjust the slope of track 60. The angle of the track could be so steep as to represent little impediment, or so shallow that the downward force component is at a minimum. In between, there is a large range of slope angles within which the rate of rotation can be adjusted.

Further, there has been disclosed an exercise machine which provides total upper body physical fitness that is affordable enough and compact enough to be used in the home or a gym. The device simulates with a very simple construction a stationary model of monkey bars or the horizontal ladder commonly used for years in playground or military training. The physical exerciser is the same as that used on the playground except that the operator remains stationary while the rungs or cross bars move.

This invention is not to be limited by the embodiment shown in the drawings and described in the description, which is given by way of example and not of limitation, but only in accordance with the scope of the appended claims.

We claim:

1. An exerciser that stimulates a horizontal ladder comprising:

a rotatable head having a horizontal axis of rotation comprising:

an axle, a pair of plates mounted on each end of said axle, a plurality of radial slots in said pair of plates, and a cross bar mounted in each of said radial slots;

support means rotatably mounting said rotatable head;

a plurality of radially displacable cross-rods mounted on said head;

track means mounted to said support means displacing at least some of said cross bars radially as said head rotates;

said track means displacing said cross-bar having a neutral point below the axis of rotation of said head and having a sloped angle;

whereby application of weight to a cross-bar immediately adjacent said neutral point on said track means causes said reel and said cross-bar to rotate toward said neutral point, said cross-rods being radially displaced during said movement.

2. The exercise according to claim 1 in which said means for displacing said cross-bars radially includes rollers mounted on each of said cross bars and adapted to roll on said track means, whereby rotation of said head causes successive cross-bar rollers to engage said track means and be displaced radially.

3. The exercise machine according to claim 2 in which there are six cross-bars equally spaced around said head.

4. The exercise machine according to claim 3 in which said plates are circular plates; said radial slots are six equally angularly spaced slots in said circular plates.

5. The exercise machine according to claim 4 including guide means engaging said rollers to guide said cross-bars in said slots when they are not on said track.

6. The exercise machine according to claim 1 in which there are six cross-bars equally spaced around said head.

7. The exercise machine according to claim 1 in which said plates are circular plates; and said radial slots are six equally equally spaced slots in said circular plates.

8. The exercise machine according to claim 1 in which adjustment means is provided adjustably to limit the rate of rotation of said head.

9. The exercise machine according to claim 8 in which said adjustment means comprises a drag brake.

10. The exercise machine according to claim 8 in which said adjustment means comprises means to adjust the slope of said track means.

* * * * *